United States Patent [19]

Sarjeant

[11] 4,348,776

[45] Sep. 14, 1982

[54] COLLAPSIBLE SPLASH SHIELD FOR TOILET

[76] Inventor: Dale C. Sarjeant, 1425 Meadowood La., Charlotte, N.C. 28211

[21] Appl. No.: 287,055

[22] Filed: Jul. 27, 1981

[51] Int. Cl.[3] ..... E03D 1/00; E03D 3/00; E03D 5/00

[52] U.S. Cl. ..... 4/300.3; 4/661; 4/DIG. 5

[58] Field of Search ..... 4/661, 300.3, DIG. 5

[56] References Cited

U.S. PATENT DOCUMENTS

| | | | |
|---|---|---|---|
| 2,583,718 | 1/1952 | Walls | 4/300.3 |
| 2,791,780 | 5/1957 | Krischer | 4/DIG. 5 |
| 2,980,919 | 10/1957 | Otto et al. | 4/DIG. 5 |
| 3,071,778 | 1/1963 | Renshaw | 4/300.3 |
| 3,193,845 | 2/1964 | Funk | 4/300.3 |
| 3,914,803 | 10/1975 | Gregovski | 4/300.3 |
| 3,931,649 | 1/1976 | Jankowski | 4/300.3 |
| 4,060,859 | 12/1977 | Anderson | 4/DIG. 5 |
| 4,133,062 | 1/1979 | Fulbright, Jr. | 4/251 |

*Primary Examiner*—Henry K. Artis

*Attorney, Agent, or Firm*—Bell, Seltzer, Park & Gibson

[57] ABSTRACT

A collapsible splash guard is provided which is adapted to be mounted in a toilet, and which is constructed for movement between an extended operative position when the toilet seat is in a raised position and a collapsed storage position when the seat is in a lowered position. The splash guard comprises a plurality of segments assembled in nested relation with one another and normally arranged in a collapsed storage position within the bowl of the toilet when the seat of the toilet is in the lowered position. The innermost of the nested segments is connected to the toilet seat in such a manner that when the toilet seat is lifted to the raised position, the innermost segment is lifted upwardly from within the bowl and the nested segments are moved with respect to one another from a nested relationship into an extended overlapping relationship positioned above the toilet bowl and forming an enclosure shieldingly surrounding the back and side portions of the bowl.

9 Claims, 10 Drawing Figures

COLLAPSIBLE SPLASH SHIELD FOR TOILET

BACKGROUND OF THE INVENTION

This invention relates to a device which may be mounted on a toilet to serve as a splash shield when the toilet is used with the toilet seat in a raised position, and which collapses to store within the toilet when the seat is in the lowered position.

Toilet guards or splash shields of the general type to which the present invention pertains are disclosed in the following U.S. Patents:

| U.S. Pat. No. | Inventor | Issue Date |
|---|---|---|
| 2,791,780 | Krischer | May 14, 1957 |
| 2,980,919 | Otto et al | April 25, 1961 |
| 3,071,778 | Renshaw | January 8, 1963 |
| 3,193,845 | Funk | July 13, 1965 |
| 3,914,803 | Gregovski | October 28, 1975 |
| 3,931,649 | Jankowski | January 13, 1976 |
| 4,060,859 | Anderson | December 6, 1977 |
| 4,133,062 | Fulbright, Jr. | January 9, 1979 |

It is an object of the present invention to provide a splash shield device adapted to form a protective enclosure shieldingly surrounding the back and side portions of a toilet. While splash shields of this general type are shown in the above-listed patents, they have a number of disadvantages and limitations which significantly restrict the usefulness or practicality of such devices. With this in mind, it is a further object of this invention to provide a splash guard which overcomes the limitations and disadvantages of the prior devices and provides a number of significant advantages thereover. It is an object of this invention to provide a splash shield which is of a simple and relatively inexpensive construction, and which is adapted to be easily mounted to the toilet. It is a further object of this invention to provide a splash shield which is of a collapsible and self-storing design, which is used when the toilet seat is in the raised position, and which does not interfere with the normal use of the toilet when the seat is in the lowered position.

SUMMARY OF THE INVENTION

In accordance with the present invention, a collapsible splash guard is provided which is comprised of a plurality of segments which are assembled in nested relation and arranged in a collapsed storage position within the bowl of the toilet when the seat of the toilet is in the lowered position. Means is provided connecting the toilet seat to the one of the nested segments so as to lift such segment upwardly from within the toilet bowl when the seat is moved to the raised position. The respective nested segments are interconnected in such a manner that when the toilet seat is raised and such segment is lifted upwardly, the other segments are moved with respect to one another from a collapsed nested relationship to an extended overlapping relationship positioned above the toilet bowl and forming an enclosure shielding the surrounding back and side portions of the toilet bowl.

In accordance with one embodiment of the invention, the segments which comrise the splash guard are of a generally U-shaped configuration when viewed in plan and have cooperating flanges which permit the nested segments to move with respect to one another in a telescoping manner from a nested relationship when the toilet seat is lowered and the splash shield is in a collapsed storage position to an extended overlapping relationship positioned above the toilet bowl when the toilet seat is in the raised position.

In another embodiment of the invention, the segments are hingedly connected together in such a manner that the segments are moved with respect to one another in a fan-like manner from a nested relationship when the toilet seat is lowered to an extended overlapping relationship positioned above the toilet bowl when the toilet seat is raised.

BRIEF DESCRIPTION OF THE DRAWINGS

Some of the features and advantages of the invention having been described, others will become apparent as the description proceeds when taken in connection with the accompanying drawings, in which.

DESCRIPTION OF ILLUSTRATED EMBODIMENTS

Figure 1:
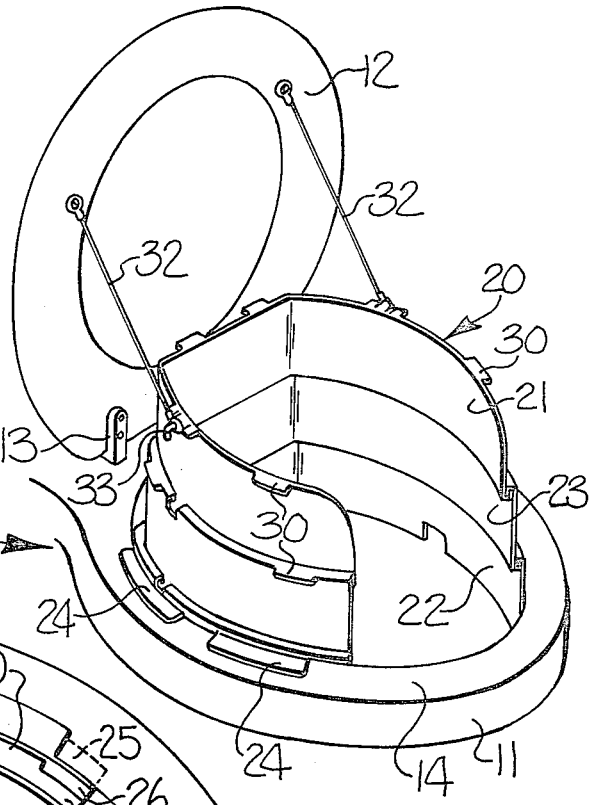
FIG. 1 is a pespective view of a toilet splash shield in accordance with one embodiment of this invention.
Figure 3:
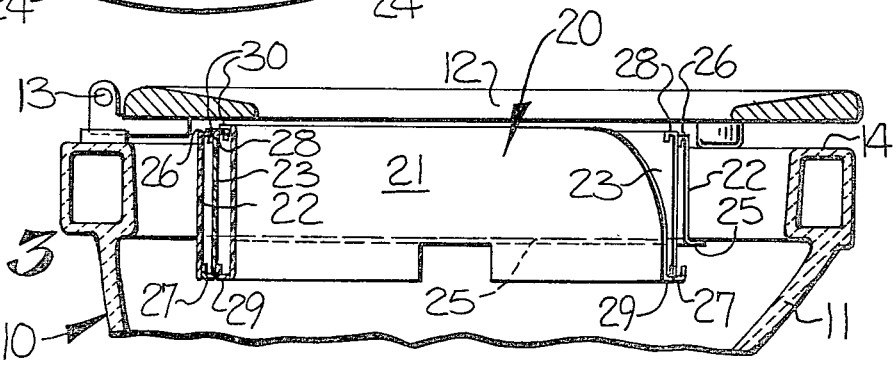
FIG. 3 is a cross-sectional elevational view from the side showing the splash shield in the collapsed storage position.

Referring now more particularly to the drawings, a conventional toilet is indicated generally in FIG. 1 by the reference character 10 and is comprised of a bowl 11 and a seat 12 connected to the bowl adjacent the rear thereof by a hinge 13 so that the seat can be moved between a lowered position as illustrated in FIG. 3 and a raised position as illustrated in FIG. 1.

Figure 2:
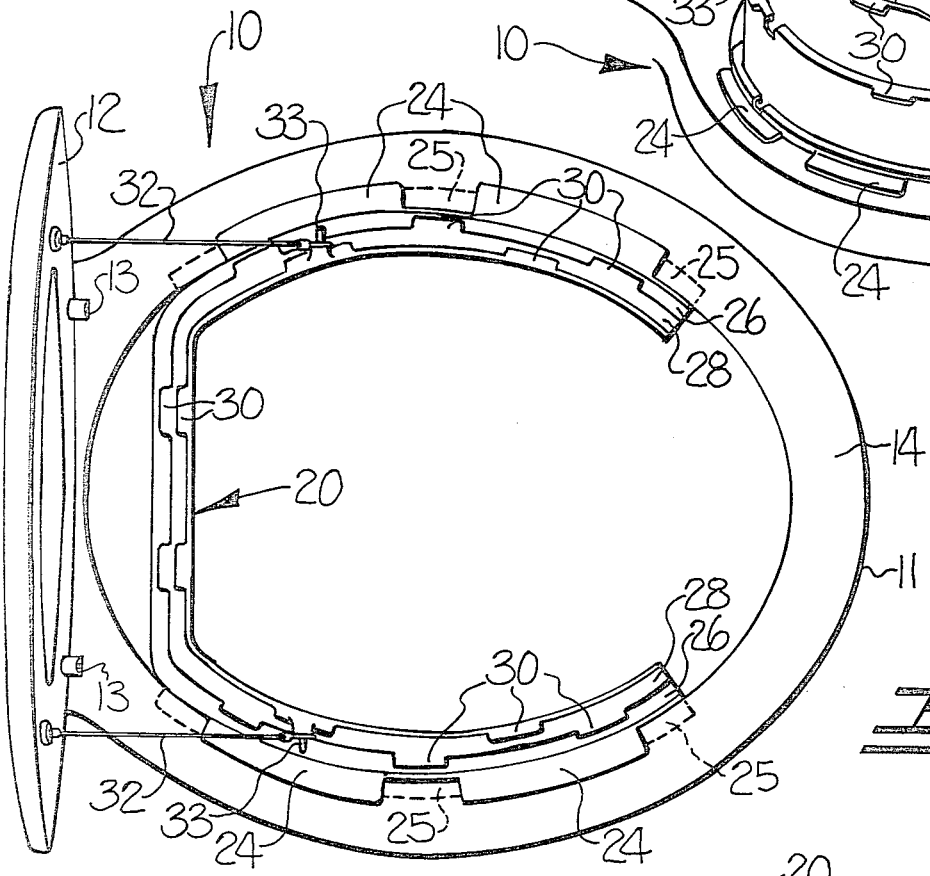
FIG. 2 is a plan view thereof.

One embodiment of a splash shield in accordance with the present invention is indicated generally by the reference character 20 and is comprised of a plurality of interconnected generally U-shaped segments assembled in nested relationship one within the other. This splash shield includes an inner segment 21 and outer segment 22 and at least one intermediate segment 23 located between the inner segment 21 and the outer segment 22. In the particular embodiment illustrated, one intermediate segment 23 is provided, although it should be apparent when the principles of operation of the splash guard are understood that more than one intermediate segment can be utilized if desired. Each segment is formed of a relatively thin sheet material, such as plastic, and has upper and lower edges which extend in generally parallel relation. As best seen in FIG. 2, the outer segment 22 has a laterally outwardly extending flange 24 provided on the upper edge thereof which serves to engage the upper surface of the rim 14 of the toilet bowl so as to retain the outer segment 23 in position in the toilet bowl. The lower edge of the outer segment 22 is provided with a laterally extending outturned flange 25 which is adapted to engage the underside of the rim 14 and to further assist in retaining the outer segment 22 in place by limiting upward movement of the outer segment 22. Preferably, the generally U-shaped outer segment 22 is constructed so that the opposing side portions are normally spaced apart a distance slightly greater than the width of the toilet bowl, and the resilient nature of the material from which the outer segment is formed allows the opposing side portion to be moved toward one another so that the side portions exert a slight outward bias to assist in holding the outer segment 22 in place on the rim 14 of the bowl 11. This construction also permits the splash guard of this invention to be used with toilets having bowls of varying width.

The outer segment 22 is additionally provided with an inturned flange 26 along the upper edge thereof, which is adapted to cooperate with an outturned flange 27 provided along the lower edge of the intermediate segment 23, as will be described more fully hereinafter. The intermediate segment 23 also has an inturned flange 28 along the upper edge thereof. The inner segment 21 has an outturned flange 29 along the lower edge thereof which is adapted to cooperate with the inturned flange 28 on the intermediate segment 23 as will be described more fully hereinafter.

The inner and intermediate segments 21, 23 also have retaining flanges 30 provided at spaced locations along the upper edges thereof. When the splash guard 20 is in the collapsed storage position, the respective U-shaped segments 21, 22, 23 are nested one within the other, and the retaining flanges 30 on the inner and intermediate segments 21, 23 engage the upper edges of the next outer segments to hold the segments in place in the collapsed position.

Figure 5:
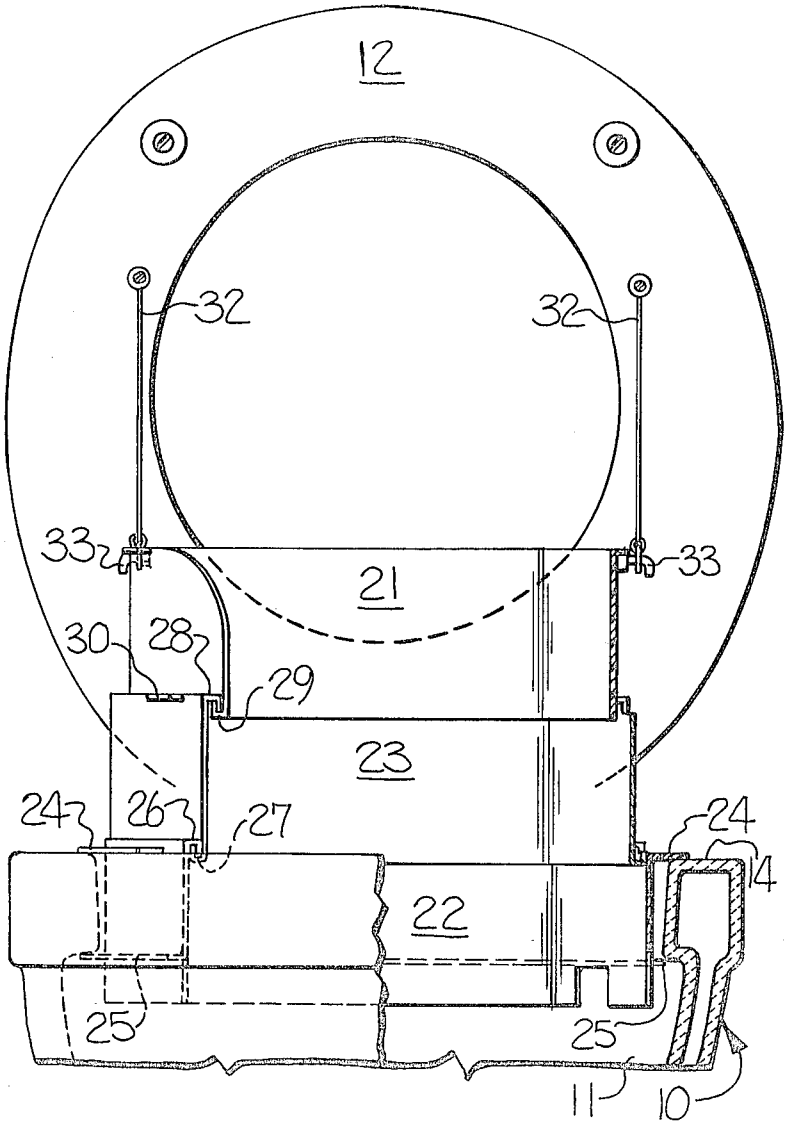
FIG. 5 is an elevational view from the front, with portions thereof shown in section.
Figure 4:
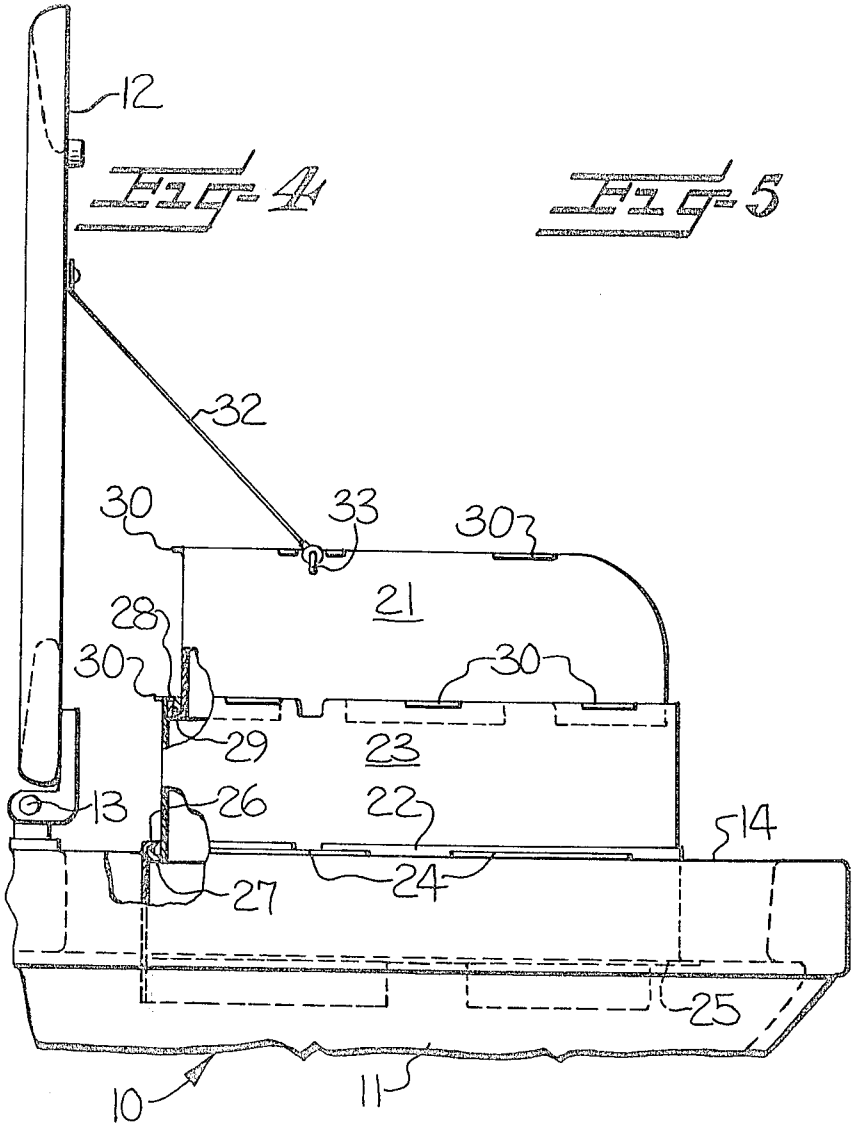
FIG. 4 is an elevational view from the side showing the splash shield in the raised operative position.
Figure 6:
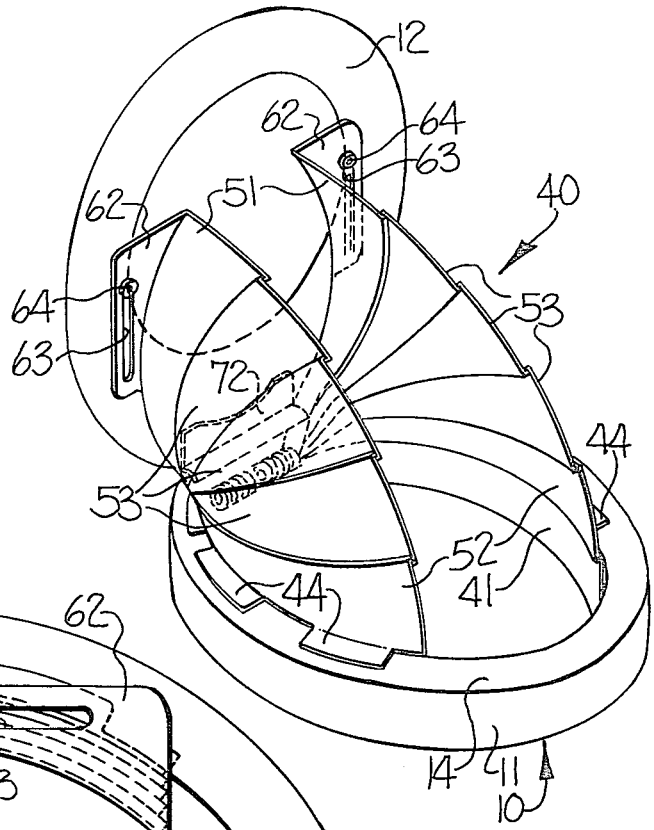
FIG. 6 is a perspective view of another embodiment of a toilet splash shield in accordance with the invention.
Figure 7:
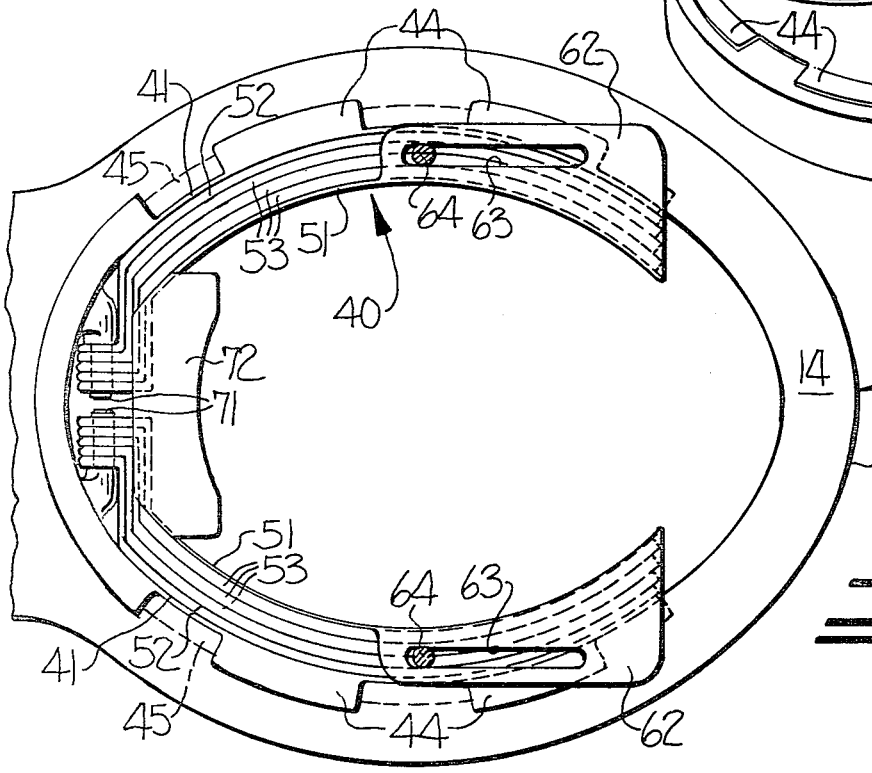
FIG. 7 is a plan view thereof in the collapsed storage position.

As seen in FIGS. 2, 4 and 5 a connector means, shown in the form of a pair of elongate flexible cords 32, has one end thereof connected to the underside of the seat 12, and the other end thereof connected to suitable pins 33 provided adjacent the upper edge of the inner segment 21. When the toilet seat 12 is moved from the lowered position to the raised position as seen in FIGS. 4 and 5, the connectors 32 pull the inner segment 21 upwardly from within the bowl 11 and the inner, outer and intermediate segments 21, 22, 23 are moved with respect to one another in a telescoping manner into an extended overlapping relationship with the flanges 26, 27 cooperating with one another and the flanges 28, 29 cooperating with one another to retain the segments in assembled relation. When the seat 12 is lowered it will be seen that the segments 21, 22, 23 will be moved by their own weight and/or by pressure from seat 12 downwardly to the collapsed storage position shown in FIG. 3.

A second embodiment of the invention illustrated in FIGS. 6 to 10 is similar in many respects to the embodiment just described. Basically, this embodiment differs from the prior embodiment in that the segments are hingedly connected to one another and move with respect to one another in a fan-like manner from the collapsed position in which the respective segments are nested one within the other to the extended operative position.

The splash guard in accordance with this embodiment of the invention is indicated generally by the reference character 40. The splash guard 40 is comprised of a stationary mounting member 41 which is carried by the rim of the toilet bowl, and to which is hingedly connected a plurality of movable segments arranged in cooperating pairs. The cooperating pairs of segments extend from the mounting member 41 forwardly toward the front of the toilet along opposite side portions of the toilet bowl. The segments, more particularly, include a pair of inner segments 51, a pair of outer segments 52 and a plurality of pairs of intermediate segments 53. Each segment is formed of a relatively thin sheet material, such as plastic, and has upper and lower edges which extend in a generally angular relationship to one another such that the segments have a predetermined relatively small height adjacent the rear of the toilet and increase in height approaching the front of the toilet. The lower edge of the outer segments 52 include laterally outwardly extending flange portions 55 which are adapted to engage the stationary mounting member 41 and limit upward movement. The outer segments 52 are also provided with an inturned flange 56 along the upper edge thereof which is adapted to cooperate with an outturned flange 57 provided along the lower edges of the adjacent intermediate segments 53. The intermediate segments 53 are each also provided with an inturned flange 58 along the upper edge thereof adapted to cooperate with the outturned flange of the adjacent inner segment. The innermost flange 51 is similarly provided with an outturned flange 59 along the lower edge thereof.

Means is also provided on the inner segment 51 to permit connecting the inner segment to the toilet seat 12. In the embodiment illustrated, this connector means takes the form of a laterally extending flange 62 carried by the upper edge of the inner segment 51. Flange 62 has an elongate slot 63 extending generally parallel to the front to rear axis of the toilet. A suitable removable fastener 64 such as a large headed screw passes through the slot 63 and is secured to the underside of the toilet seat 12.

The stationary mounting member 41 is of a generally U-shaped configuration and is adapted to fit within the rim 14 of the toilet bowl and to be held in place thereby. An outwardly extending upper flange 44 engages the top surface of the rim, and an outwardly extending lower flange 45 engages the underside of the rim. An inturned flange 48 serves to engage the outermost flange 55 of segment 52 when the segment is raised. A pair of supports 49 limit downward movement of the segments when the segments are in collapsed nested position. The stationary mounting plate 41 has a pair of hinge pins 71 carried thereby, and the respective right and left halves of the segments 51, 52, 53 are connected to the pins 71 so as to unite the right and left halves of the segments and to mount the same for pivotal movement along the axis of the hinge pins 71. A shield plate 72 overlies the hinge pins.

Figure 9:
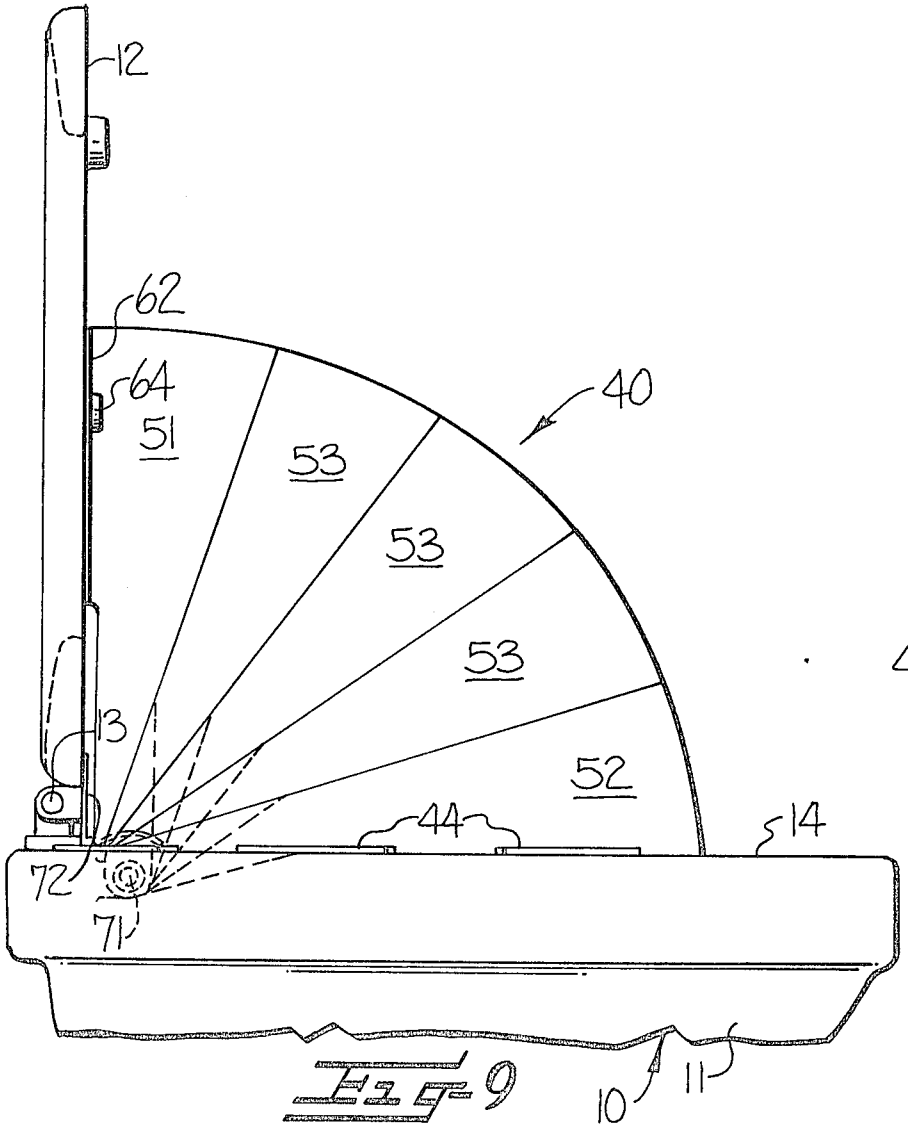
FIG. 9 is a side elevational view of the splash shield in the raised operative position.

As best seen in FIG. 9, since the axis of the hinge pins 71 is offset from the axis of the hinge 13 of seat 12, the segments 51, 52, 53 and the seat 12 do not follow the same precise arc of movement. However, the elongate slot 63 provided in the flange 62 accommodates this difference in the arc of movement as the seat is moved from the lowered position to the raised position.

Figure 8:
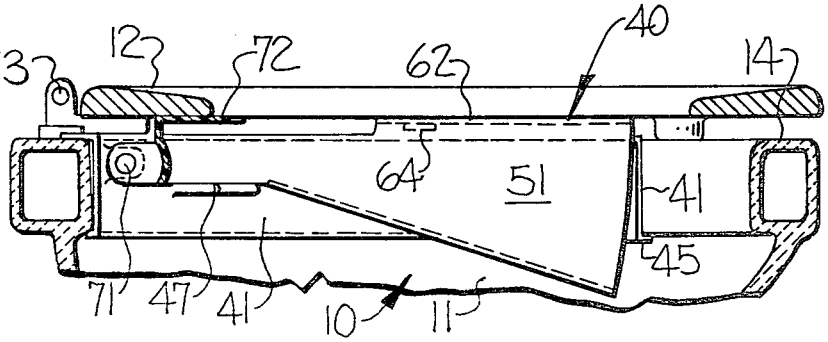
FIG. 8 is a cross-sectional view from the side.
Figure 10:
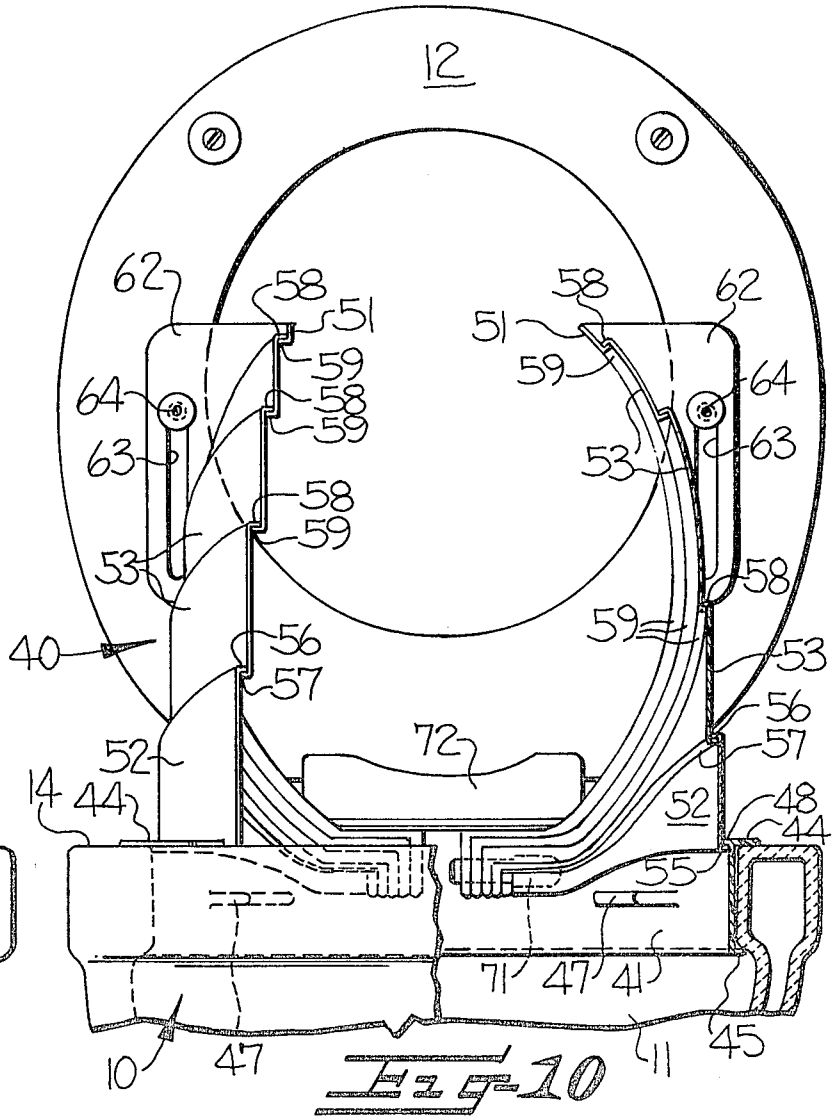
FIG. 10 is an elevational view from the front, with portions shown in section.

It will thus be seen that when the seat is moved from the lowered position shown in FIG. 8 to the raised position shown in FIG. 9, the respective segments move with respect to one another in a fan-like manner from the collapsed storage position in which the respective segments are nested one within the other to the extended operative position in which the segments overlap with one another and cooperate to form an enclosure shieldingly surrounding the back and side portions of the toilet bowl. When the seat 12 is lowered, the respective segments will again return to a nested collapsed relationship for storage within the toilet bowl.

In the drawings and specification there have been set forth several preferred embodiments of the invention, and although specific terms are employed, they are used in a generic and descriptive sense only and not for purposes of limitation.

That which is claimed is:

1. A collapsible splash guard for use with a toilet having a bowl and a seat hingedly connected to the bowl adjacent the rear of the bowl, said splash guard being adapted for movement between an extended operative position when the toilet seat is in the raised position and a collapsed storage position when the seat is in a lowered position, and said collapsible splash guard comprising a plurality of segments assembled in nested relationship and adapted to extend along opposite side portions of the toilet bowl, said segments being arranged in a collapsed storage position within the bowl of the toilet when the seat is in the lowered position, means for connecting one of said nested segments to the toilet seat so that said one segment is lifted upwardly from within the bowl when the toilet seat is moved to the raised position, means interconnecting the respective nested segments so that when the toilet seat is raised and said one segment is lifted upwardly, the other segments are moved with respect to one another from said collapsed nested relationship to an extended overlapping relationship positioned above the toilet bowl and forming an enclosure shieldingly surrounding the toilet bowl.

2. A collapsible splash guard as set forth in claim 1 wherein said nested segments are each of a generally U-shaped configuration with a medial portion positioned at the rear of the toilet bowl and with opposing side portions extending therefrom along opposite side portions of the bowl.

3. A collapsible splash shield as set forth in claim 1 wherein said nested segments are hingedly interconnected for movement in a fan-like manner from a collapsed nested relationship to an extended overlapping relationship.

4. A collapsible splash guard as set forth in claim 2 or 3 wherein said means for connecting one of the nested segments to the toilet seat is carried by the innermost of said segments, and wherein the outermost of said segments includes means for connecting said outermost segment to the rim of the toilet bowl.

5. In a toilet having a bowl and a seat hingedly connected to the bowl adjacent the rear of the bowl, the combination therewith of a collapsible splash guard mounted for movement between an extended operative position when the toilet seat is in the raised position and a collapsed storage position when the seat is in a lowered position, said collapsible splash guard comprising a plurality of segments assembled in nested relationship and extending along opposite side portions of the toilet bowl, said segments being arranged in a collapsed storage position within the bowl of the toilet when the seat is in the lowered position, means connecting the toilet seat to one of said nested segments and being operative for lifting said one segment upwardly from within the bowl when the toilet seat is moved to the raised position, means interconnecting the respective nested segments so that when the toilet seat is raised and said one segment is lifted upwardly, the other segments are moved with respect to one another from said collapsed nested relationship to an extended overlapping relationship positioned above the toilet bowl and forming an enclosure shieldingly surrounding the toilet bowl.

6. In a toilet having a bowl and a seat hingedly connected to the bowl adjacent the rear of the bowl, the combination therewith of a collapsible splash guard mounted for movement between an extended operative position when the toilet seat is in the raised position and a collapsed storage position when the seat is in a lowered position, said collapsible splash guard comprising a plurality of segments, each having upper and lower edges and being of a generally U-shaped configuration with a medial portion positioned at the rear of the toilet bowl and with opposing side portions extending therefrom along opposite side portions of the bowl, said segments being assembled in nested relationship and arranged one within the other in a collapsed storage position within the bowl of the toilet when the toilet seat is in the lowered position, means connecting the toilet seat to one of said nested segments and being operative for lifting said one segment upwardly from within the bowl when the toilet seat is moved to the raised position, and cooperating flange means carried by the upper and lower edges of the respective segments and cooperating with one another for interconnecting the respective nested segments so that when the toilet seat is raised and said one segment is lifted upwardly, the other segments are moved with respect to one another in a telescoping manner from said collapsed nested relationship to an extended overlapping relationship positioned above the toilet bowl and forming an enclosure shieldingly surrounding the back and side portions of the toilet bowl.

7. In a toilet having a bowl and a seat hingedly connected to the bowl adjacent the rear of the bowl, the combination therewith of a collapsible splash guard mounted for movement between an extended operative position when the toilet seat is in the raised position and a collapsed storage position when the seat is in a lowered position, said collapsible splash guard comprising an inner segment, an outer segment, and at least one intermediate segment positioned between said inner and outer segments, each of said segments being formed of a relatively thin sheet material, each having upper and lower edges extending generally parallel and being of a generally U-shaped configuration with a medial portion positioned at the rear of the toilet bowl and with opposing side portions extending therefrom and along opposite side portions of the bowl, said segments being assembled in nested relationship and arranged one within the other in a collapsed storage position within the bowl of the toilet when the seat is in the lowered position, means connecting said outer segment to the toilet bowl, an elongate flexible connector having one end connected to said toilet seat and the other end connected to said inner segment and being operative for lifting said inner segment upwardly from within the bowl when the toilet seat is moved to the raised position, an outturned flange provided along the lower edge of said inner segment and along the lower edge of said at least one intermediate segment, an inturned flange provided along the upper edge of said outer segment and along the upper edge of said at least one intermediate segment, each said inturned flange cooperating with the outturned flange of the adjacent inner segment for interconnecting the respective nested segments in a telescoping arrangement so that when the toilet seat is raised and said inner segment is lifted upwardly the other segments are moved with respect to one another in a telescoping manner from said collapsed nested relationship to an extended overlapping relationship positioned above the toilet bowl and forming an enclosure shieldingly surrounding the back and side portions of the toilet bowl.

8. In a toilet having a bowl and a seat hingedly connected to the bowl adjacent the rear of the bowl, the combination therewith of a collapsible splash guard mounted for movement between an extended operative position when the toilet seat is in the raised position and a collapsed storage position when the seat is in a lowered position, said collapsible splash guard comprising a stationary mounting member carried by the rim of the toilet bowl and a plurality of movable segments connected to said mounting member and extending therefrom along opposite side portions of the toilet bowl, said movable segments being assembled in nested relationship and arranged in a collapsed storage position within the bowl of the toilet when the seat is in the lowered position, means connecting the toilet seat to one of said nested segments and being operative for lifting said one segment upwardly from within the bowl when the toilet seat is moved to the raised position, said stationary mounting member including means hingedly interconnecting the respective nested movable segments so that when the toilet seat is raised and said one segment is lifted upwardly, the other segments are moved with respect to one another in a fan-like manner from said collapsed nested relationship to an extended overlapping relationship positioned above the toilet bowl and forming an enclosure shieldingly surrounding the back and side portions of the toilet bowl.

9. In a toilet having a bowl and a seat hingedly connected to the bowl adjacent the rear of the bowl, the combination therewith of a collapsible splash guard mounted for movement between an extended operative position when the toilet seat is in the raised position and a collapsed storage position when the seat is in a lowered position, said collapsible splash guard comprising a stationary mounting member carried by the rim of the toilet bowl and a plurality of cooperating pairs of movable segments connected to said stationary mounting member and extending therefrom toward the front of the toilet along opposite side portions of the toilet bowl, said cooperating pairs of segments being assembled in nested relationship and including an inner pair of segments, an outer pair of segments, and at least one intermediate pair of segments positioned therebetween, each of said segments being formed of a relatively thin sheet material having upper and lower edges extending angularly with respect to one another so as to be of increasing height approaching the front of the toilet and said segments being arranged in a collapsed storage position within the bowl of the toilet when the seat of the toilet is in the lowered position, a laterally outwardly extending flange portion carried by the opposing side portions of each of said inner segments and extending underlying the seat of the toilet and having an elongate slot formed therein and extending parallel to the front-rear axis of the toilet, fastener means carried by the underside of said toilet seat and extending through said slot and cooperating therewith for operatively interconnecting said inner segment to the toilet seat so as to lift said inner pair of segments upwardly from within the bowl when the toilet seat is moved to the raised position, hinge means carried by said stationary mounting member and operatively interconnecting the respective nested segments so that when the toilet seat is raised and said innermost pair of segments is lifted upwardly, the other pairs of segments are moved with respect to one another in a fan-like manner from said nested relationship to an extended overlapping relationship positioned above the toilet bowl and forming an enclosure shieldingly surrounding the back and side portions of the toilet bowl.

* * * * *